US006308332B1

(12) United States Patent
Tollini

(10) Patent No.: US 6,308,332 B1
(45) Date of Patent: Oct. 30, 2001

(54) FASTENER FOR BANDAGE

(76) Inventor: Michael D. Tollini, 9193 Beech Meadow Ct., Clarence Center, NY (US) 14032

( * ) Notice: Subject to any disclaimer, the term of this patent is extended or adjusted under 35 U.S.C. 154(b) by 0 days.

(21) Appl. No.: 09/619,918

(22) Filed: Jul. 20, 2000

Related U.S. Application Data

(63) Continuation-in-part of application No. 08/906,410, filed on Aug. 5, 1997, now Pat. No. 6,108,814.

(51) Int. Cl.[7] ..... A01K 27/00
(52) U.S. Cl. ..... 2/22; 119/856
(58) Field of Search ..... 2/22, 16, 24, 62, 2/338, 311, 908, 910, 911, 312, 321, 322, 326; 24/306, 442; 128/DIG. 15; 119/850, 856

(56) References Cited

U.S. PATENT DOCUMENTS

| | | | | |
|---|---|---|---|---|
| 487,296 | | 12/1892 | Rowell . | |
| 903,149 | | 11/1908 | Bowlds . | |
| 1,395,689 | | 11/1921 | McKenzie . | |
| 1,622,211 | * | 3/1927 | Sheehan | 2/22 |
| 1,899,471 | | 2/1933 | Meyer . | |
| 2,512,925 | | 6/1950 | Eggeman . | |
| 2,817,841 | | 12/1957 | Bilecki . | |
| 3,004,519 | | 10/1961 | Weissman . | |
| 3,193,984 | | 7/1965 | Schubert . | |
| 3,209,516 | | 10/1965 | Hyman . | |
| 3,209,517 | | 10/1965 | Hyman . | |
| 3,387,305 | | 6/1968 | Shafer . | |
| 3,735,419 | | 5/1973 | Byrd . | |
| 4,140,116 | | 2/1979 | Hampicke . | |
| 4,378,009 | | 3/1983 | Rowley et al. . | |
| 4,424,809 | | 1/1984 | Yovankin . | |
| 4,470,411 | | 9/1984 | Hoyt, Jr. . | |
| 4,497,070 | | 2/1985 | Cho . | |
| 4,700,406 | * | 10/1987 | Meistrell | 2/22 |
| 4,805,606 | | 2/1989 | McDavid, III . | |
| 4,834,079 | | 5/1989 | Benckhuijsen . | |
| 4,888,826 | | 12/1989 | Parsons, Jr. et al. . | |
| 5,016,621 | | 5/1991 | Bender . | |
| 5,107,827 | | 4/1992 | Boyd . | |
| 5,222,256 | * | 6/1993 | Wang | 2/24 |
| 5,226,191 | * | 7/1993 | Mitchell | 2/24 |
| 5,450,625 | | 9/1995 | Hu . | |
| 5,537,689 | | 7/1996 | Dancyger . | |
| 5,560,041 | * | 10/1996 | Walker | 2/24 |
| 5,611,080 | | 3/1997 | Skottheim . | |
| 5,628,063 | | 5/1997 | Reed . | |
| 5,711,028 | | 1/1998 | Bourque et al. . | |
| 5,742,945 | | 4/1998 | Lindaman . | |
| 5,910,126 | | 6/1999 | Wilson et al. . | |
| 6,101,629 | * | 8/2000 | Colling | 2/24 |
| 6,108,814 | * | 8/2000 | Tollini | 2/22 |

FOREIGN PATENT DOCUMENTS

| | | | |
|---|---|---|---|
| 15750 | | 12/1885 | (GB) . |
| 757414 | * | 9/1956 | (GB) . |

* cited by examiner

*Primary Examiner*—John J. Calvert
*Assistant Examiner*—Tejash Patel
(74) *Attorney, Agent, or Firm*—Joseph P. Gastel

(57) ABSTRACT

A fastener for a shin guard mounted on the leg of a horse including upper and lower bands connected at their ends by diagonal bands, fork bands connecting the outer ends of the upper and lower bands to each other, a band of pile fabric extending outwardly from one of the fork bands, and a band of hook fabric extending outwardly from the other of the fork bands.

22 Claims, 10 Drawing Sheets

A
B
C
D

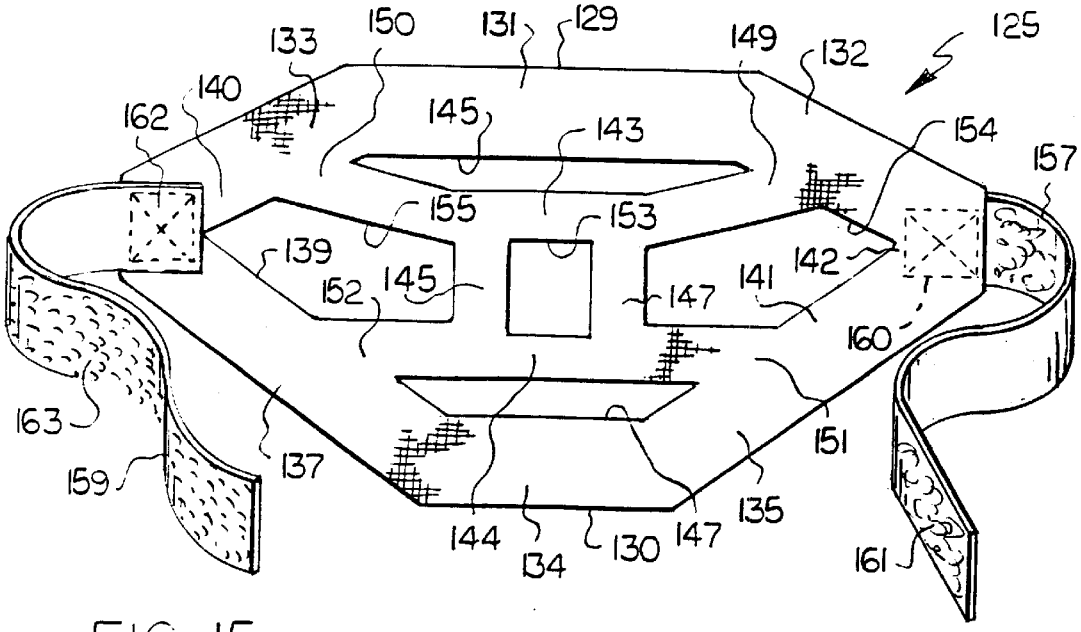
FIG. 15
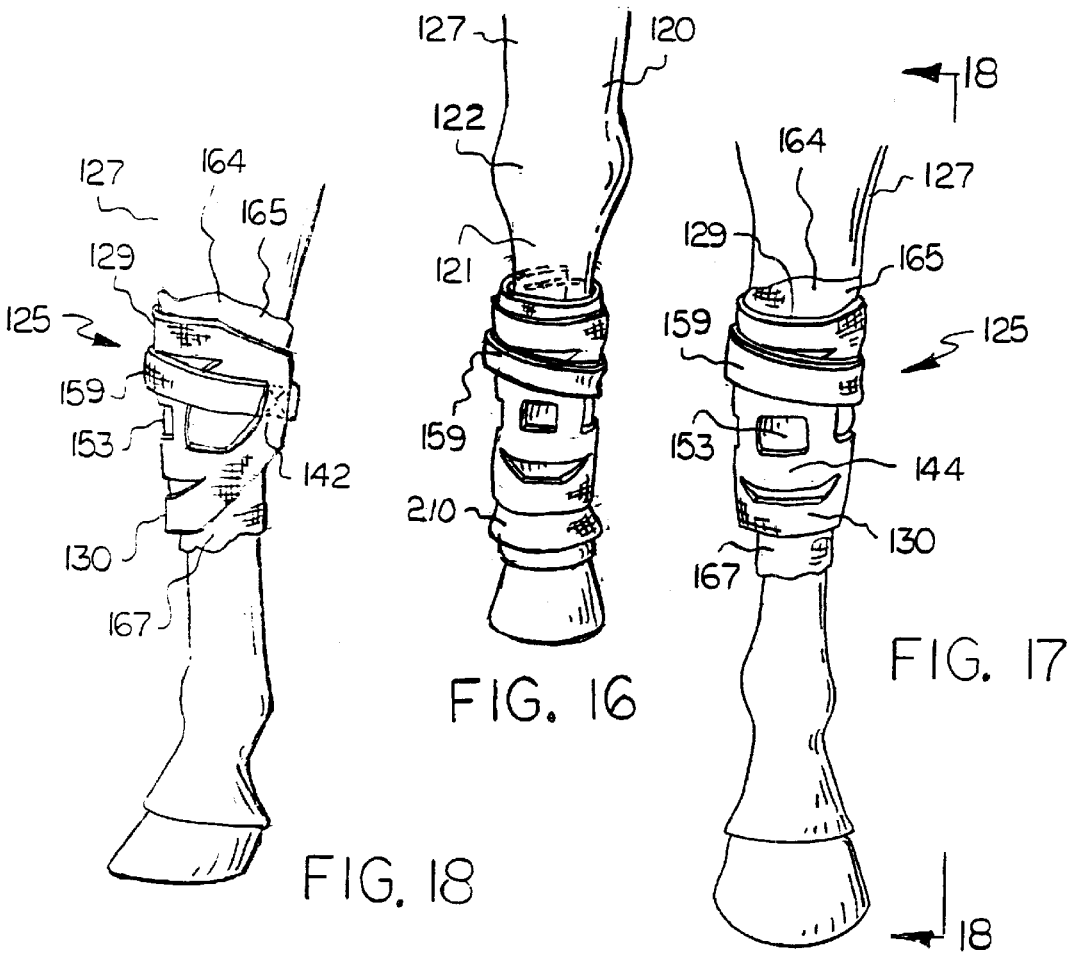
FIG. 16
FIG. 17
FIG. 18

FASTENER FOR BANDAGE

CROSS-REFERENCE TO RELATED APPLICATIONS

The present application is a continuation-in-part of application Ser. No. 08/906,410, filed Aug. 5, 1997 now U.S. Pat. No. 6,108,814.

STATEMENT REGARDING FEDERALLY SPONSORED RESEARCH OR DEVELOPMENT

Not Applicable

BACKGROUND OF THE INVENTION

The present invention relates to a fastener for holding a bandage in position on the leg of a horse.

In parent application Ser. No. 08/906,410, filed Aug. 5, 1997, now U.S. Pat. No. 6,108,814, a fastener for a shin guard was disclosed for use in sports such as hockey wherein shin guards are used to protect the shins of a player. The fasteners of the prior application were extremely satisfactory in that they held shin guards of various shapes firmly in position without cutting off circulation in the leg of the wearer.

By way of background, medicinal bandages of various types are applied to the legs of horses. However, holding such bandages in position is extremely difficult because of the irregular nature of a horse's leg and also because of the sometimes violent movements of the leg. Also, bandages in the form of protective pads are wrapped about the legs of horses between the knee and the hoof under various circumstances to protect these portions of the legs against damage due to the horse's kicking them, especially when the horses are being transported in vans and in other circumstances where a stabled horse is likely to kick its legs. In the past, the securing of such pads was time-consuming and often after the pad was fastened, it was not held securely in place. It is with a fastener for bandages of the foregoing types that the present invention is concerned.

BRIEF SUMMARY OF THE INVENTION

It is accordingly one object of the present invention to provide an improved fastener for a bandage for a horse's leg wherein there are multiple areas of contact longitudinally of the bandage both in front and on the sides and on the rear of the various irregular areas of the horse's leg.

Another object of the present invention is to provide a fastener for a bandage for a horse's leg which provides multiple areas of contact while requiring only a single area for fastening the fastener.

A further object of the present invention is to provide an improved fastener for a bandage for a horse's leg wherein attachment members at the outer ends of the fastener, when attached to each other, are acted on by forces from many different directions which tends to prevent the fastener from unfastening.

A still further object of the present invention is to provide a fastener with a cupped area for a bandage applied to a three dimensional area on a horse's leg. Other objects and attendant advantages of the present invention will readily be perceived hereafter.

The present invention relates to a fastener for securing a bandage applied to a leg of a horse comprising an upper band structure, a lower band structure spaced from said upper band structure, first and second opposite ends on said upper band structure, third and fourth opposite ends on said lower band structure, a first band joined to said first and third ends, a second band joined to said second and fourth ends, and attachment members on said first and second bands.

The present invention also relates to the combination of a bandage applied to a leg of a horse and a fastener for securing said bandage in position, said fastener comprising an upper band structure, a lower band structure spaced from said upper band structure, first and second opposite ends on said upper band structure, third and fourth opposite ends on said lower band structure, a first band joined to said first and third ends, a second band joined to said second and fourth ends, and attachment members on said first and second bands, said band structures encircling said bandage, and said attachment members being secured to each other.

The various aspects of the present invention will be more fully understood when the following portions of the specification are read in conjunction with the accompanying drawings wherein:

BRIEF DESCRIPTION OF THE SEVERAL VIEWS OF THE DRAWING

FIG. 15 is a plan view of a fastener of the present invention which is used for securing a bandage on a horse's leg;

FIG. 16 is a fragmentary schematic view of a portion of a horse's foreleg showing an irregular shape of a horse's knee and also showing a bandage in the form of a pad secured to a horse's leg between the knee and the hoof by a fastener of the present invention;

FIG. 17 is a frontal view of the improved fastener of the present invention securing a bandage in position about the knee on a horse's foreleg;

FIG. 18 is a side view taken substantially in the direction of arrows 18—18 of FIG. 17;

DETAILED DESCRIPTION OF THE INVENTION

Figures 1, 2, 3, 4:
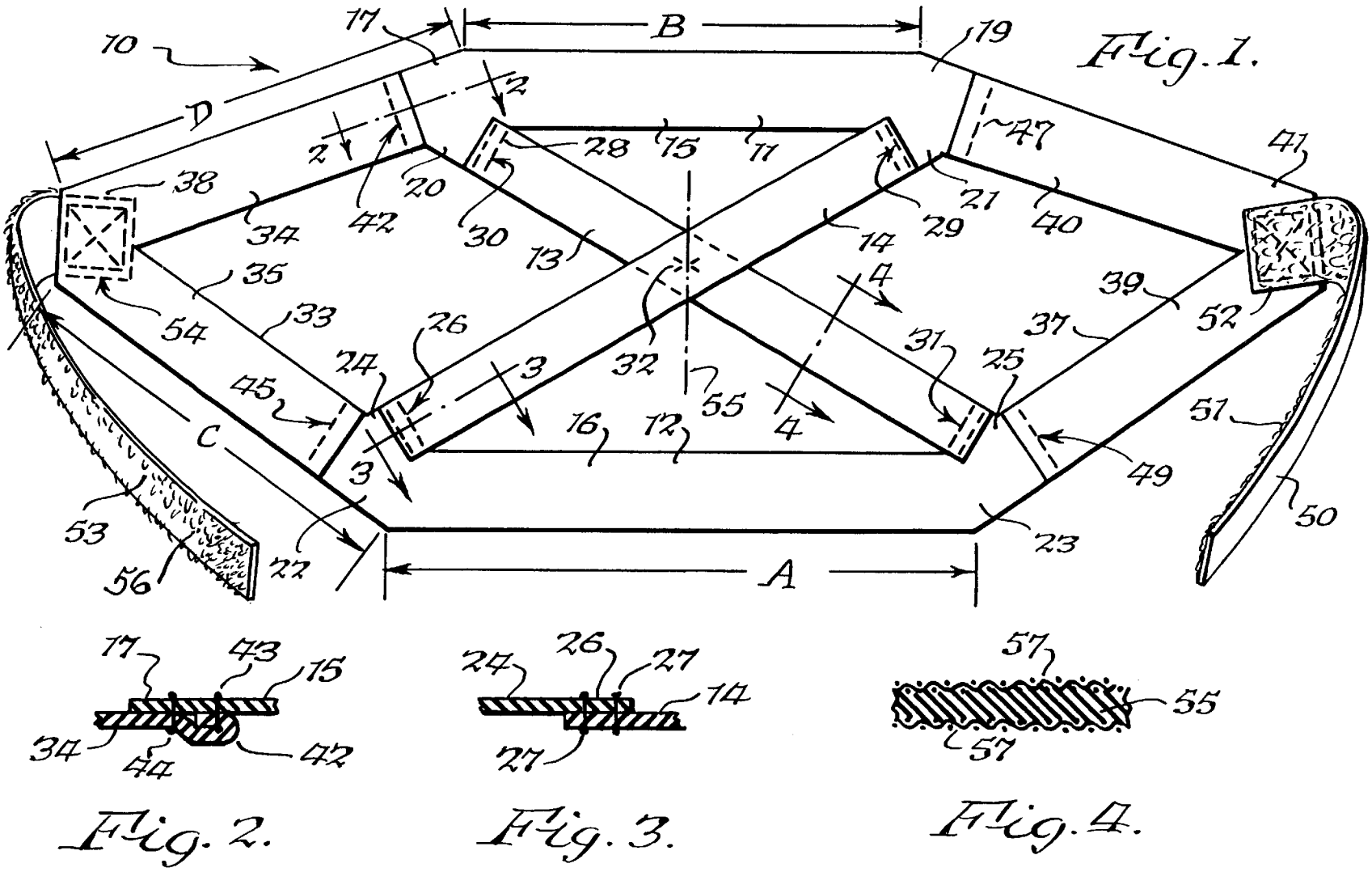
FIG. 1 is a plan view of the fastener which was previously used for securing a shin guard on a leg, with the view showing the outside surface thereof.
FIG. 2 is a fragmentary cross sectional view taken substantially along line 2—2 of FIG. 1 and showing the type of seam which is used at this junction.
FIG. 3 is a fragmentary cross sectional view taken substantially along line 3—3 of FIG. 1 and showing the lap type of seam used at this junction.
FIG. 4 is a fragmentary cross sectional view taken substantially along line 4—4 of FIG. 1 and showing the type of material which is used for all of the parts except for the attachment members on the outer end portions of the fastener.

Relative to the previous shin guard fastener shown in FIGS. 1–12, the central portion of shin guard fastener 10 of the includes an upper band structure 11, a lower band structure 12, and diagonal bands 13 and 14 effectively extending between upper band structure 11 and lower band structure 12. Upper band structure 11 includes a horizontal band 15 having downwardly sloping ends 17 and 19 which are mirror image counterparts. Downwardly sloping ends 17 and 19 include tab portions 20 and 21, respectively. Lower band structure 12 includes a horizontal band 16 and inclined ends 22 and 23 which are mirror image counterparts. Inclined end 22 includes a tab 24 and inclined end 23 includes a tab 25. The ends of diagonal band 14 are secured to tabs 21 and 24 by means of sewn lap joints 26 and 29. Lap joint 26 includes two rows of stitching 27, and lap joint 29 is the mirror image of lap joint 26. The outer ends of diagonal band 13 are sewn to tabs 20 and 25 by means of sewn lap joints 30 and 31, respectively. Lap joint 30 includes two rows of stitching 28, and lap joint 31 is essentially the mirror image of lap joint 30. Diagonal bands 13 and 14 are preferably threadably tacked to each other at their crossover area 32, but they need not be tacked. Also bands 13 and 14 can be sewn to each other in any suitable manner at their crossover area 32.

The upper band structure 11 of previous shin guard fastener 10 includes bands 34 and 40, and the lower band structure 12 includes bands 35 and 39. Bands 34 and 35 comprise a forked member 33 having a vertex 38. Bands 39 and 40 comprise a forked member having a vertex 41. Thus, the left end 17 of upper band 11 and the left end 22 of lower band 12 are connected to each other by a forked connecting member 33 having band portions 34 and 35 which are formed integrally at their vertex 38. The right end 19 of upper band 11 and the right end 23 of lower band 12 are connected to each other by forked connecting member 37 consisting of bands 39 and 40 which are integrally joined at vertex 41.

As can be seen from the above description, the upper band structure 11 and the lower band structure 12 are multiple band structures because they consist of a plurality of bands. The diagonal bands 13 and 14 are also a multiple band structure in the form of an X.

FIG. 2 shows the joint 42, which is known as a sew seam reverse and topstitch joint, wherein the end 17 of band 15 is initially stitched to the end of band 34 by a row of stitching 43 when band 34 is laid on tab 17 and thereafter band 34 is turned 180° and tab 17 is stitched to band 34 by a row of stitching 44. Seam 45 is also a sew seam reverse and topstitch seam, and it is the mirror image of seam 42. Seam 47 is the mirror image of seam 42 and seam 49 is the mirror image of seam 45. A band 50 is stitched by means of a lap joint 52 to vertex 41 of member 37. Band 50 has an attachment member in the form of a pile surface 51 thereon. A band 53 having an attachment member in the form of a hook surface 56 is attached to vertex 38 at a lap joint by stitching 54. Bands 50 and 53 preferably extend upwardly from the horizontal at approximate angles of 10°, but they need not extend upwardly at an angle.

The material from which all parts except attachment members 51 and 53 are made is stretchable and resilient, and it consists essentially of elastic neoprene foam core 55 bounded by knit fabric sides 57, and it is a commercial product of the Griswold Rubber Co. Thus, all parts except attachment members 50 and 53 are stretchable and resilient so as to conform to a leg about which they are wound.

By way of example and not of limitation a model has been made up having the following dimensions. Dimension A is 12 inches. Dimension B is 9 inches. Dimension C is 7½ inches, and dimension D is also 7½ inches. The fastener 10 is symmetrical about centerline 55.

FIGS. 5–9 are schematic representations of the steps used in mounting the shin guard fastener 10 onto a leg having a shin guard thereon, and FIGS. 9–12 show the fastener in fully mounted position. In these series of figures, the fastener 10 is schematically shown with only major portions thereof having numerals thereon.

Figure 5:
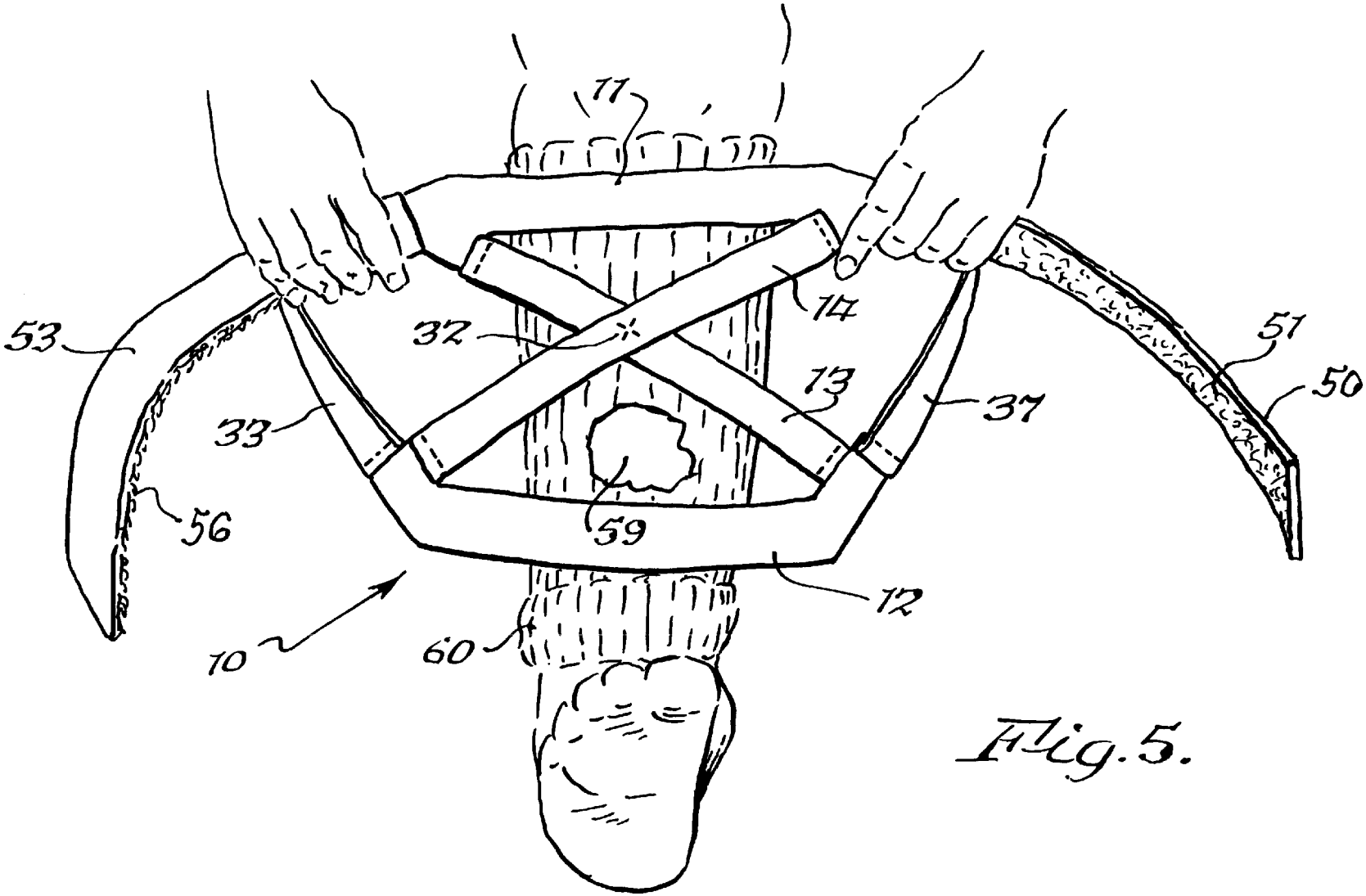
FIG. 5 is a fragmentary front elevational view showing the first step in mounting the fastener on a leg having a shin guard thereon.

In FIG. 5 the fastener 10 is shown in the initial position which it occupies with its upper band 11 against the upper portion of the shin and the lower band 12 against the lower portion of the shin. More specifically, the fastener 10 is shown as being used against the leg of a hockey player which mounts a shin guard 59 underneath a stocking 60. It will be appreciated that the shin guard 59 can be of any suitable type which is used in hockey, or if the fastener 10 is to be used with shin guards of other types, it can be visualized that shin guard 59 is the type used with such other sports.

Figure 6:
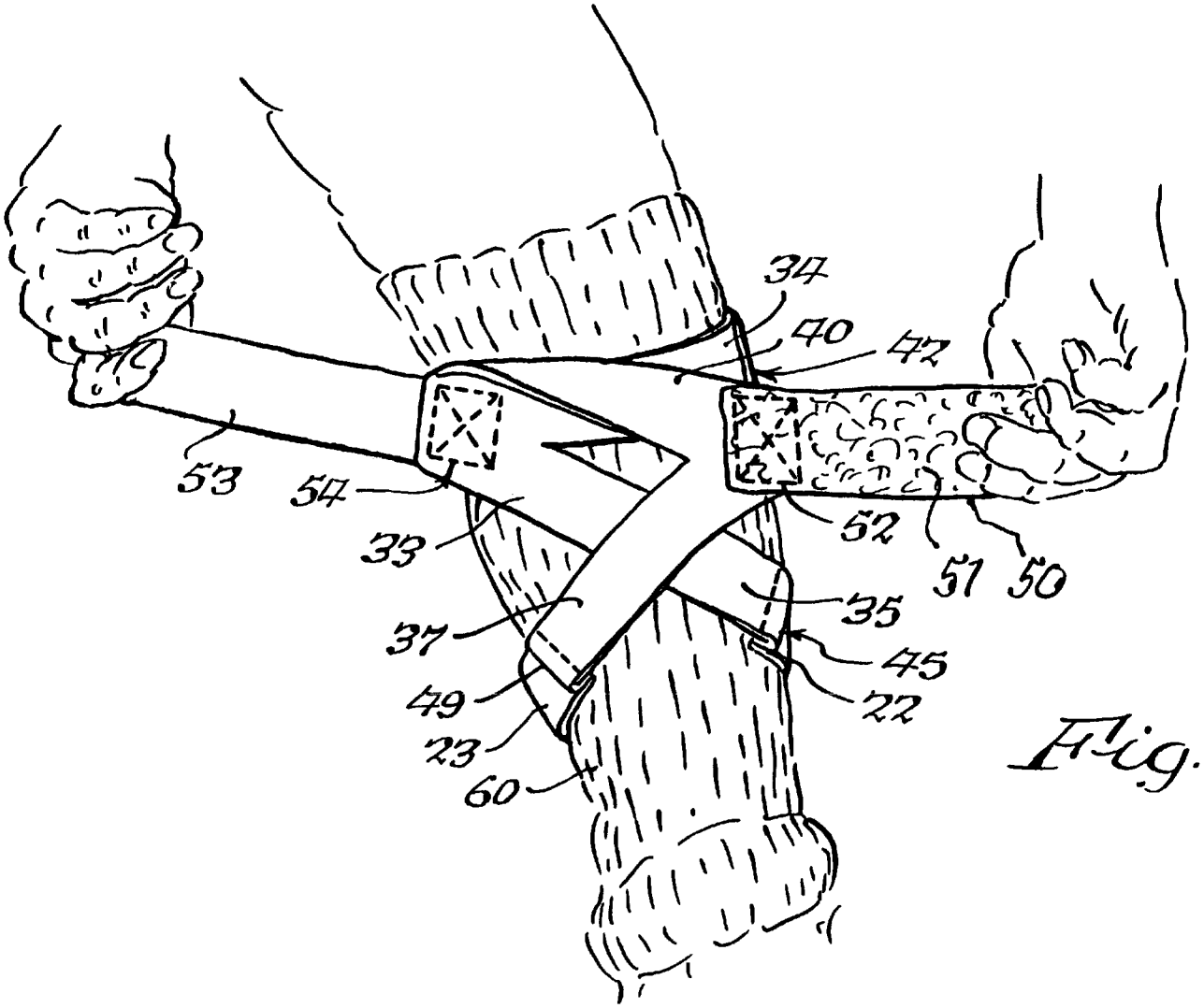
FIG. 6 is a rear elevational view of a leg with the fastener wrapped around the rear thereof during an initial stage of mounting the fastener on the leg.
Figure 7:
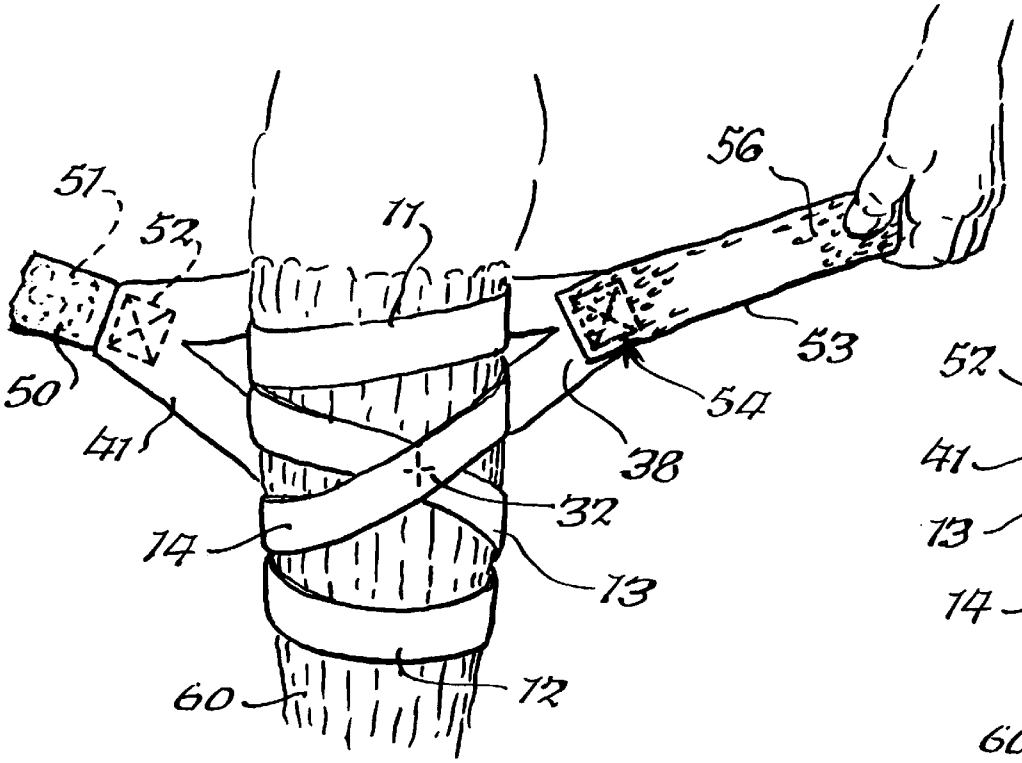
FIG. 7 is a front elevational view corresponding to the rear elevational view of FIG. 6.

In FIG. 6 a rear view of the leg is shown with the connecting member 33 threaded through the connecting member 37. At this time, the central portion of the shin guard 10 is pulled tightly against the front and sides of the leg. In FIG. 7 shin guard fastener 10 is shown on the front of the leg, and it corresponds to the position of the fastener 10 in FIG. 6.

Figure 8:
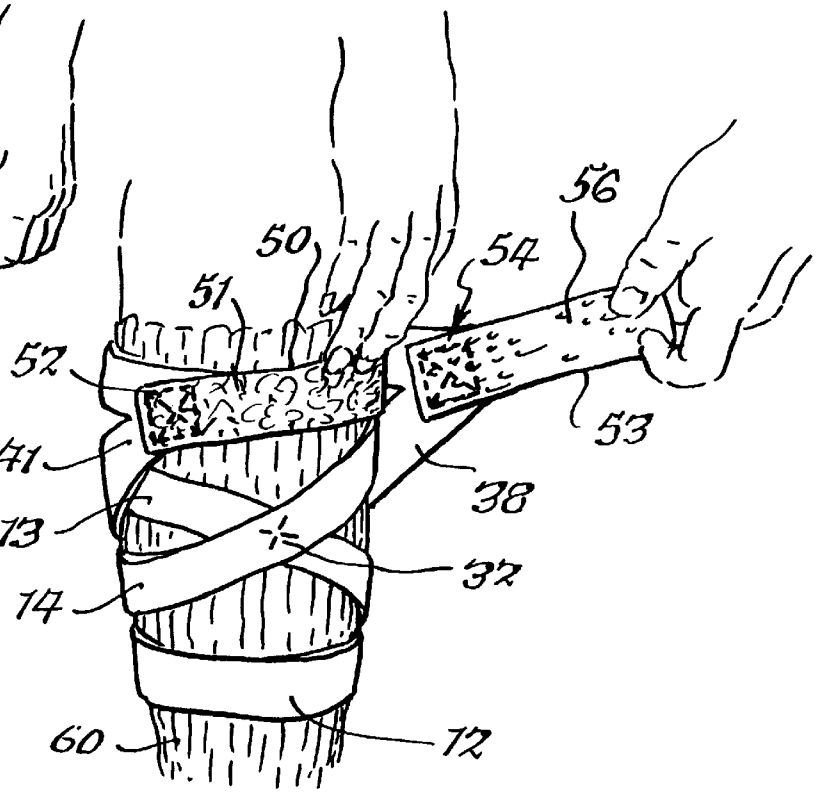
FIG. 8 is a front elevational view illustrating the next step of mounting the fastener on the leg by laying down the attachment member with pile thereon onto the shin.
Figure 9:
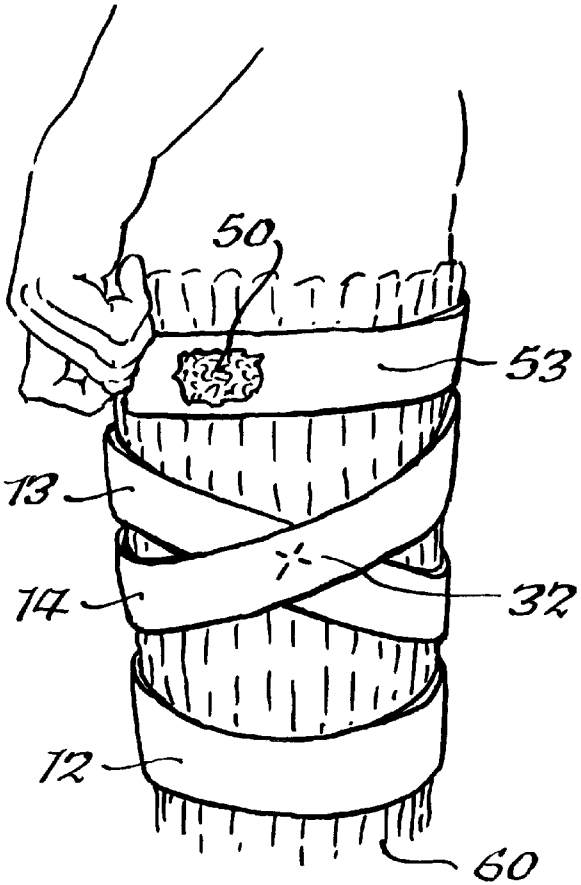
FIG. 9 is a front elevational view showing the attachment member with loops thereon being fastened to the attachment member having pile thereon.

In FIG. 8 the next position is shown wherein the attachment member 50 is laid against the shin with the pile 51 facing away from the shin while the connecting member is held in the position shown. In FIG. 9 the fastening member 53 is fastened to fastening member 50 by engaging the hooks on member 53 with the pile on member 50.

Figure 10:
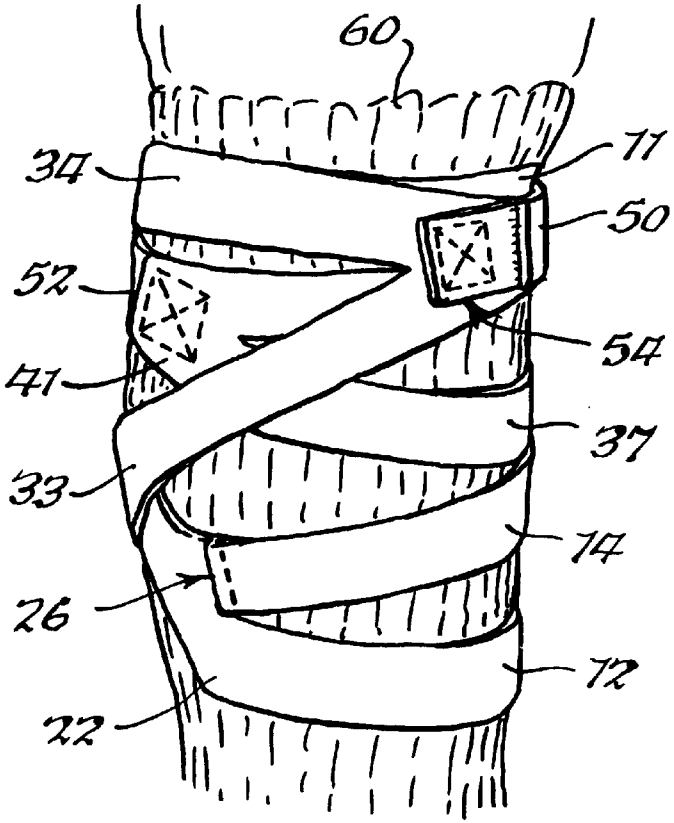
FIG. 10 is a side elevational view of the fully mounted fastener on the right side of the leg.
Figure 12:
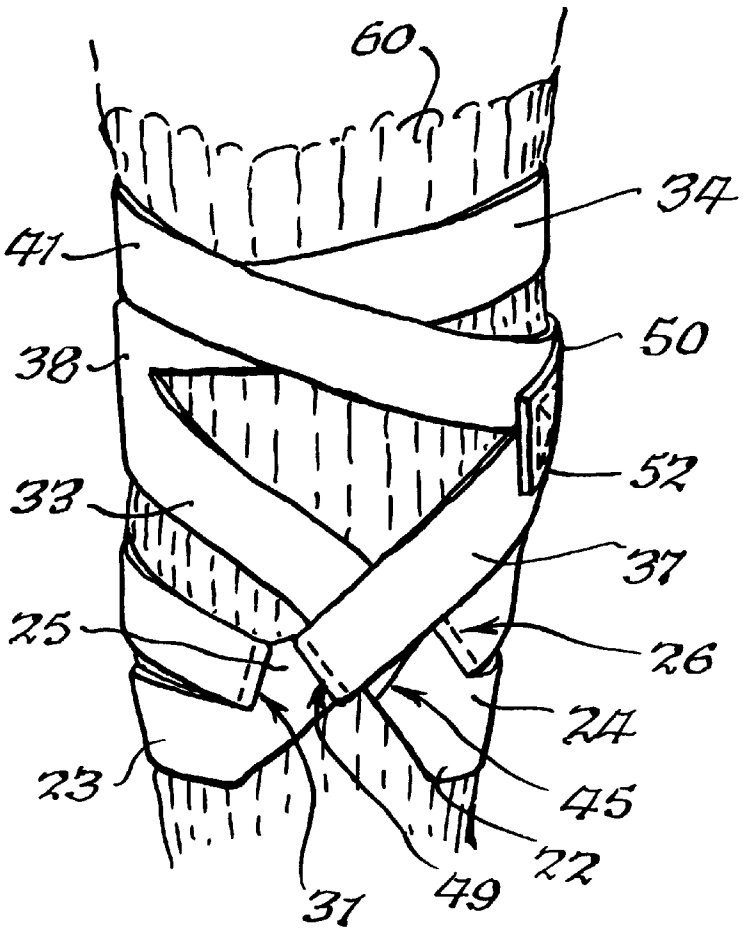
FIG. 12 is a rear elevational view showing the fastener in fully mounted position on the leg.
Figure 11:
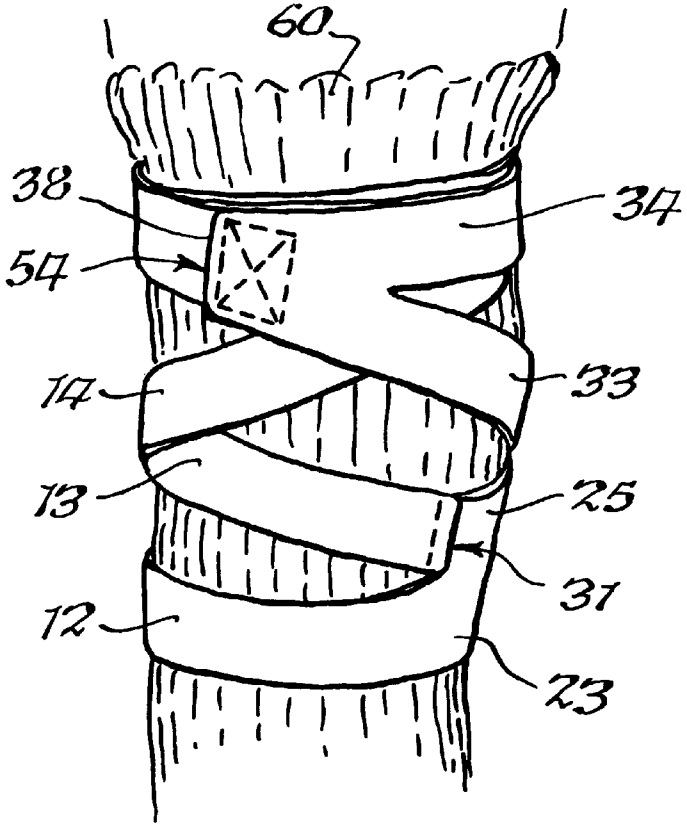
FIG. 11 is a fragmentary side elevational view of the fully mounted fastener on the left side of the leg.

In FIGS. 10, 11 and 12, the positions of the various parts of the fastener 10 are shown when the fastener 10 is in fully installed position on the leg of a person wearing a shin guard.

Figure 13:
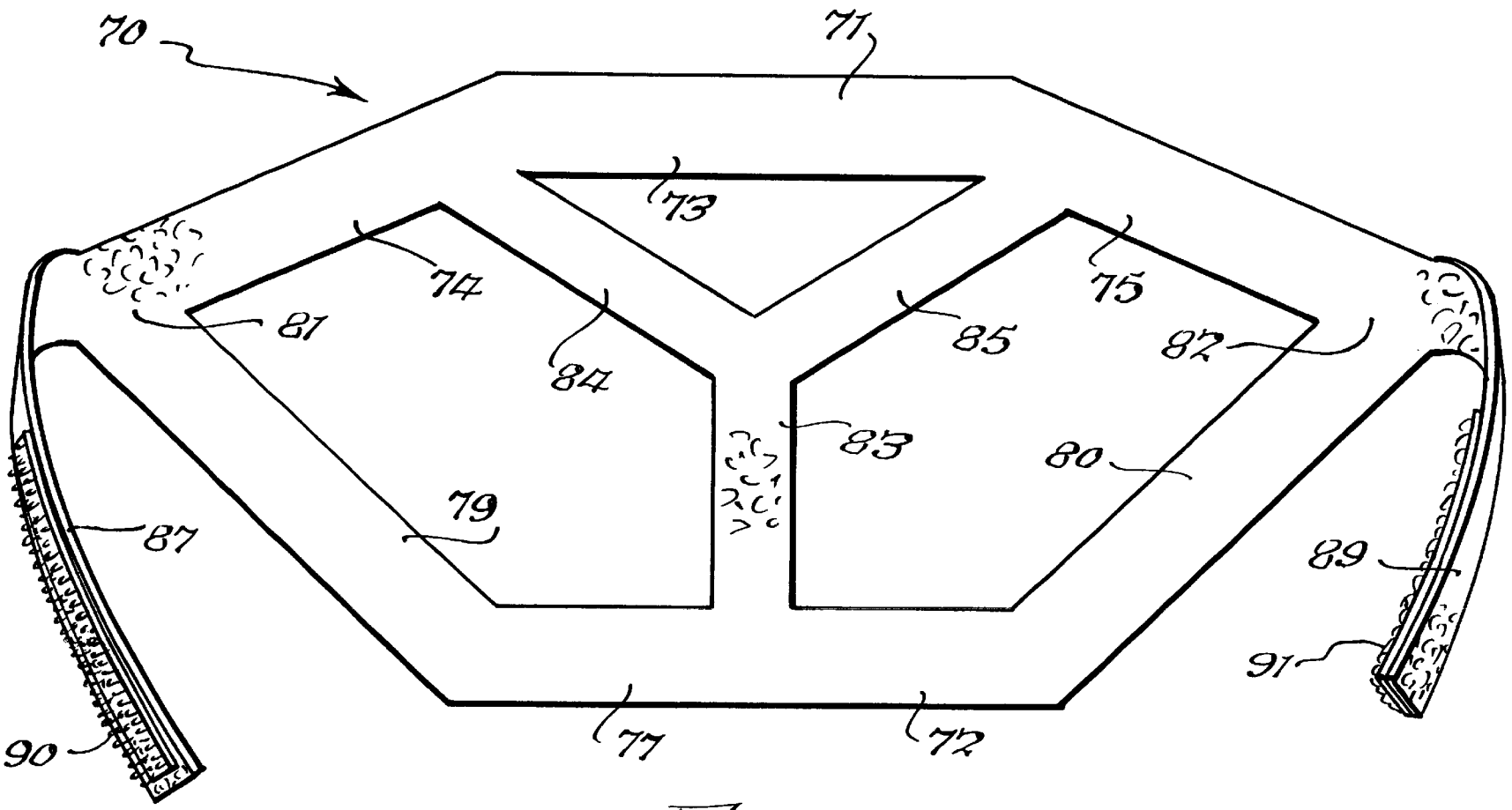
FIG. 13 is a plan view of another embodiment of the present invention.

In FIG. 13 a previous shin guard fastener 70 is shown which has a different configuration than the shin guard fastener of FIG. 1. Fastener 70 includes upper band structure 71 and lower band structure 72. Band structure 71 includes an upper band 73 and downwardly extending bands 74 and 75. Lower band structure 72 includes lower band 77 and upwardly extending bands 79 and 80. Bands 73 and 77 are substantially parallel to each other, and lower band 77 is longer than upper band 73. Bands 74 and 79 are joined at vertex 81. Bands 75 and 80 are joined at vertex 82. Band 83 extends upwardly from the central portion of band 77, and bands 84 and 85 extend upwardly and outwardly from the end of band 83 and are connected to the upper band structure 71 proximate the outer ends of upper band 73. Bands 83, 84 and 85 are in a configuration of a Y. Bands 87 and 89 extend outwardly from vertices 81 and 82, respectively. Hook fabric 90 is suitably attached to band 87, and pile fabric 91 is suitably attached to band 89. The various bands of shin guard fastener 70 are fabricated of the same material described above relative to the embodiment of FIG. 1. Also while FIG. 13 does not show how the various bands are attached to each other, it will be appreciated that shin guard fastener 70 may be fabricated by cutting from a single piece of material, or the various bands can be sewn to each other in any suitable manner including the manner discussed above relative to the embodiment of FIG. 1. Alternately, fastener 70 can be made of a combination of bands which are integral with each other and bands which are sewn to each other. The shin guard fastener 70 of FIG. 13 is mounted on the leg of an athlete in the same manner as described above relative to the embodiment of FIG. 1.

The upper band structure 71 and the lower band structure 72 are multiple band structures because they each consist of a plurality of bands. Additionally, the Y-band structure consisting of bands 83, 84 and 85 is also a multiple band structure because it consists of a plurality of bands.

Figure 14:
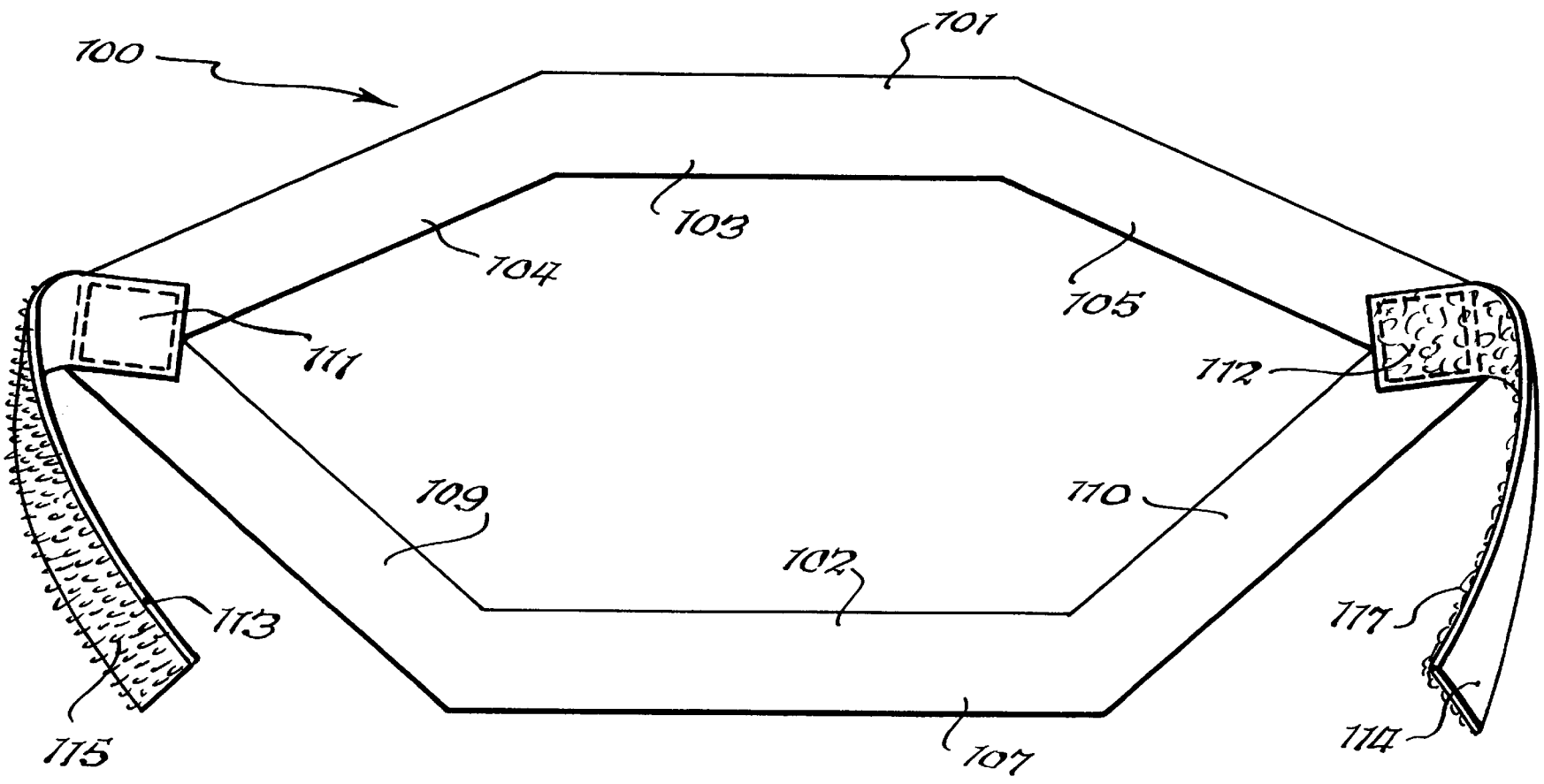
FIG. 14 is a plan view of still another embodiment of the present invention.
Figure 19:
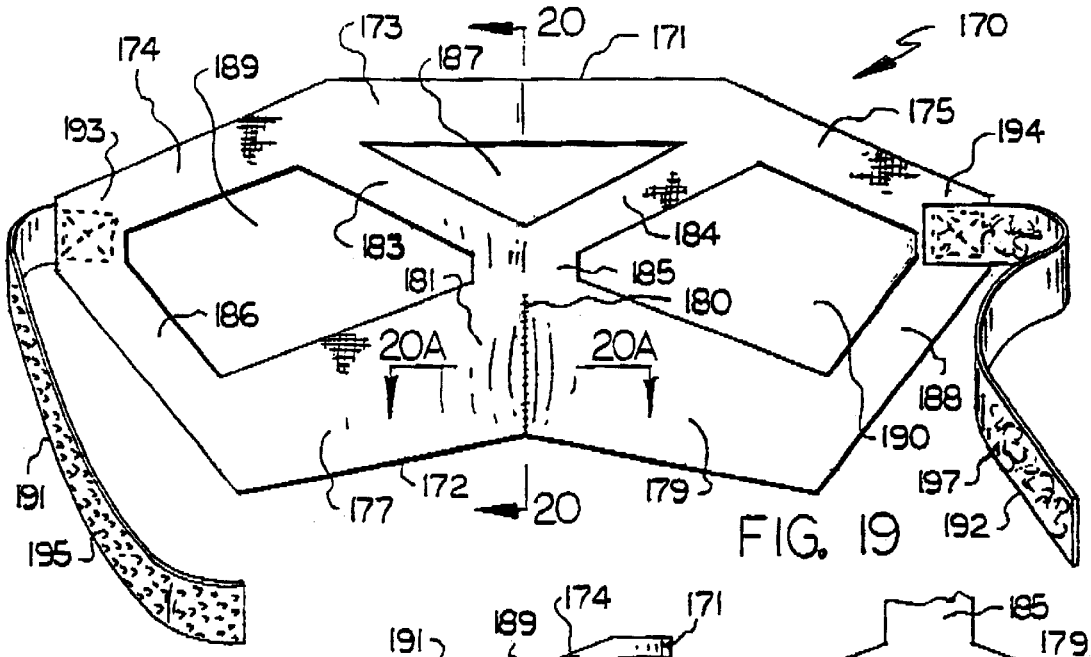
FIG. 19 is a plan view of another embodiment of a fastener having a cupped area for a bandage applied to a three dimensional area on a horse's leg.

In FIG. 14 a previous shin guard fastener 100 is shown which has a still different configuration. It includes an upper band structure 101 and a lower band structure 102. The upper band structure 101 includes a band 103, and bands 104 and 105 extend downwardly from upper band 103. The lower band structure 102 includes a lower band 107, and bands 109 and 110 extend upwardly from band 107. Bands 103 and 107 are substantially parallel to each other, and band 107 is longer than band 103. Bands 104 and 109 are joined at vertex 111, and bands 105 and 110 are joined at vertex 112. Band 113 is sewn relative to bands 104 and 109 at vertex 111, and band 114 is sewn relative to bands 105 and 110 at vertex 112. An attachment member in the form of hook fabric 115 extends outwardly from the face of band 113, and an attachment member in the form of pile fabric 117 extends outwardly from the face of band 114. The body of shin guard fastener 100 consisting of the various bands may be cut from a single piece of material, or each of the individual bands may be sewn at their junctures in any suitable manner including those disclosed above relative to FIG. 1, or there can be a combination of integral connections and sewn joints among the various bands. The shin guard fastener is fabricated from the same material set forth above relative to FIG. 1. Also, the shin guard fastener 100 is mounted on the leg of an athlete in substantially the same manner as discussed above relative to the embodiment of FIG. 1.

The upper band structure 101 and the lower band structure 102 are multiple band structures because they consist of a plurality of bands. In the embodiment 100 of FIG. 14 there is no multiple band structure between the upper band structure 101 and the lower band structure 102.

While hook and pile fabrics are the preferred way of attaching the shin guard fasteners to the leg, it will be appreciated that other types of fasteners such as clips, buckles, etc. may be used. Also, while the preferred embodiment has been made of bands sewn together, it will be appreciated that the shin guard fastener may be made out of a single piece of material.

While the above description has specifically shown multiple band structures in the form of an X and in the form of a Y between the upper and lower band structures, it will be appreciated that the band structures between the upper band structure and the lower band structure may be in any desired configuration including any combination of one or more horizontal bands, one or more vertical bands, and one or more bands which are inclined to the upper and lower band structures.

One embodiment of the fastener of the present invention for a bandage on a horse's leg is shown in FIGS. 15–18, and it contains essentially the same basic structure as the fastener for a shin guard described above relative to the preceding figures. The structure of the fastener of FIGS. 15, 17 and 18 is manifestly suitable for holding a bandage on an irregularly shaped portion of the horse's leg. This bandage may be in the form of a medicinal poultice applied to the leg which is within a wrapping of any suitable type about which the fastener of the present invention is applied, or the bandage may be in any other form. This can be visualized from the schematic representation of FIG. 16 which shows the knee joint of a horse's foreleg. More specifically, the horse's foreleg includes an upper portion 120, a lower portion 121 and a knee joint 122. It will be appreciated that the knee portion of a horse's foreleg is of an irregular shape in its normal state, and it becomes more so due to swelling of the knee joint or other maladies to which it may be subjected. Thus, a bandage which is applied to a injured or malformed knee joint and the adjacent portions of a horse's leg constitutes an irregular shape which is not only difficult to fasten in position when the leg is static but is even more difficult to maintain in position when the horse's leg is subjected to violent movements.

Also, as expressed above, the portion of a horse's leg between the knee and the hoof is subject to injury when the horse kicks itself, as could occur when the horse is being transported in a van or when the horse produces violent movement when it is stabled. In the past, bandages in the form of quilted pads, such as 210, were wrapped around the legs of horses, but fastening such pads was not only time-consuming, but also often the pads were not fastened in such a manner that they were held securely in position.

Both the type of bandage described above which is applied to the knee and the quilted pad are considered bandages which are applied to a horse's leg.

The improved fastener 125 holds a bandage firmly in position on a highly irregular knee portion of a horse's leg 127. The fastener 125 is made out of the same materials fully disclosed above relative to FIGS. 1–14 and it has basically the same shape. More specifically, it includes an upper band structure 129 and a lower band structure 130. Upper band structure 129 includes a horizontal band 131 and bands 132 and 133 sloping downwardly therefrom. Lower band structure 130 includes a central horizontal band 134 and bands 135 and 137 sloping upwardly therefrom. Bands 133 and 137 comprise a forked member 139 having a vertex 140. Bands 132 and 135 comprise a forked member 141 having a vertex 142.

A plurality of bands are located between upper band structure 129 and lower band structure 130. More specifically, an upper intermediate band structure 143 underlies upper band structure 129 and an intermediate lower band structure 144 is located above lower band structure 130. There is an open space 145 between upper band structure 129 and upper intermediate band structure 143, and there is an open space 147 between lower band structure 130 and intermediate band lower band structure 144. Spaced vertical bands 145 and 147 connect intermediate portions of upper intermediate band structure 143 and lower intermediate band structure 144. The ends of upper intermediate band structure 143 merge into upper bands 132 and 133 at 149 and 150, respectively. The opposite ends of lower intermediate band structure 144 merge into bands 135 and 137 at 151 and 152, respectively. An opening 153 is located at the central portion of fastener 125 between vertical bands 145 and 147 as shown, and this opening is utilized for centering on the front of the horse's knee or any other area of the horse's leg. The fastener 125 also includes openings 154 and 155 as shown.

Bands 157 and 159 are secured to vertices 142 and 140, respectively, by suitable stitching. Band 157 is thus stitched by means of a lap joint 160 to vertex 142 and it has an attachment portion in the form of a pile surface 161 thereon. Band 159 is stitched by means of a lap joint 162 to vertex 140 and it has an attachment portion in the form of a hook surface 163 thereon.

As noted above relative to the embodiments of FIGS. 1–14, the material from which all parts, except attachment members 157 and 159, are made is stretchable and resilient, and it consists essentially of an elastic neoprene core bonded by knit fabric as discussed in detail above. All parts except attachment members 157 and 159 are stretchable and resilient so as to conform to an irregular portion of a horse's foreleg or any other portion of a horse's foreleg or hind leg as required to hold a bandage firmly in position on the leg without cutting off blood circulation.

The fastener 125 is mounted on a horse's knee in the following manner. The opening 153 is centered on the front of the knee, as shown in FIG. 17, and the same procedure described above relative to FIGS. 5–12 is followed. In this respect, the fastener 125 is centered on the front of the leg with the surfaces on portions of the inner sides of the fastener facing the bandage and the sides of the fastener are wound around the sides of the leg. Thereafter, band 157 is threaded through opening 155 or band 159 is threaded through opening 154 in a manner which is analogous to that shown in FIG. 6. The fastener is then pulled tight by pulling on bands 157 and 159. Thereafter, band 157 with the pile fabric 163 thereon is laid across the front of the horse's leg with the pile side 161 away from the leg and thereafter band 159 (FIG. 17) with the hook fabric 161 facing toward the horse's leg is pressed onto the pile on band 159 to retain the fastener 125 in position. It will readily be appreciated because of the flexibility, resilience and stretchable nature of the fastener 125, it will conform to the irregular nature of the horse's leg and hold the bandage 164 firmly in position. As can be seen from FIGS. 17 and 18, the upper portion 165 of bandage 164 extends outwardly above fastener 125 and the lower portion 167 of bandage 164 extends downwardly below fastener 125.

The fastener 125 is secured to a bandage in the form of a quilted pad 210 in substantially the same manner as described above relative to the bandage which is applied to the horse's knee. In this respect, after the pad is wrapped around the horse's leg, as shown in FIG. 16, and the edge of the pad is initially secured to an adjacent portion of the pad, as by one or more hook and pile fastener strips, the fastener 125 is applied to the bandage in the manner described above, to secure the pad in a firm position on the leg.

Figure 20A:
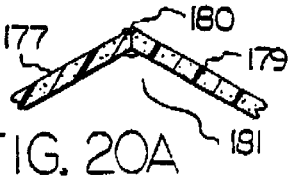
FIG. 20A is a fragmentary cross sectional view taken substantially along line 20A—20A of FIG. 19.
Figure 20:
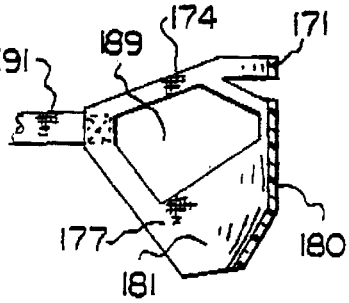
FIG. 20 is a reduced cross sectional view taken substantially along line 20—20 of FIG. 19.
Figure 20B:
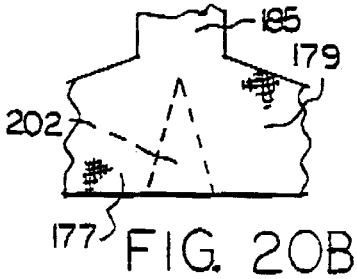
FIG. 20B is a fragmentary plan view showing how the cupped portion of the lower band structure is fabricated.
Figure 21:
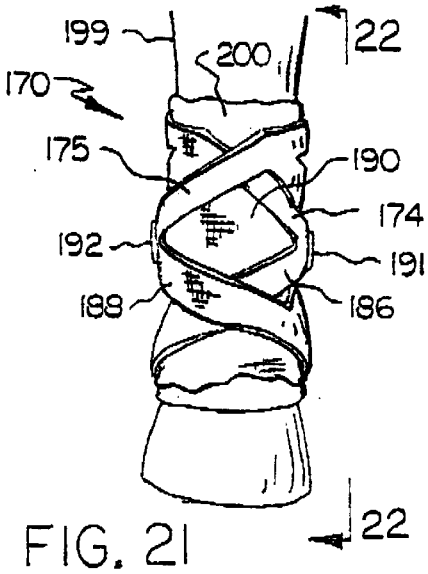
FIG. 21 is a front elevational view of the fastener of FIG. 19 applied to the lower hind leg of a horse.
Figure 22:
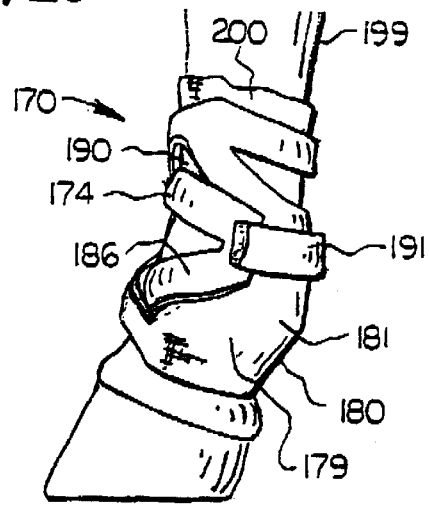
FIG. 22 is a view taken substantially in the direction of the arrows 22—22 of FIG. 21.

In FIGS. 19–22 another embodiment of a fastener 170 for a bandage dressing on a horse's leg is disclosed. Fastener 170 includes upper band structure 171 and lower cupped band structure 172. Upper band structure 171 includes a horizontal band 173 and bands 174 and 175 sloping downwardly therefrom. Cupped band structure 172 includes band sections 177 and 179 which are sewn together at 180 to provide a cupped portion 181 (FIGS. 20A and 22). The cupped portion 181 results from the band portions 177 and 179 being attached to each other at an angle, as shown in FIG. 20A. The angle between band portions 177 and 179, as shown in FIG. 20A, is formed, as shown in FIG. 20B, by cutting a triangular wedge 202 from the bottom band, when it is flat, and thereafter sewing the remaining adjacent portions of bands 177 and 179 to each other at seam 180. The triangular wedge which is cut is of isosceles shape with its base being along the lower edge of lower band structure 172. Bands 183 and 184 are located as shown and their lower ends are connected to cupped portion 181 by portion 185. Bands 186 and 188 connect the band sections 177 and 179 to bands 174 and 175, respectively, at vertices 193 and 194. A band 191 is stitched to vertex 193 with a lap joint and band 192 is stitched to vertex 194 with a lap joint. Band 191 has hook fabric 195 thereon and band 192 has pile fabric 197 thereon.

The fastener 170 is applied to a horse's hind leg 199 in the following manner. The cupped portion 181 is mounted on the bandage 200 which is on the fetlock of the horse's leg. After the cupped portion 181 has been placed over the bandage on the fetlock, the band 192 is drawn through opening 189 and thereafter wound around the horse's leg until it lies over the cupped portion 181 on the rear of the horse's leg with the pile 197 facing outwardly. Thereafter, the band 191 is wound around the horse's leg until it reaches the rear thereof with the hook fabric 195 facing the pile fabric 197 onto which it is pressed.

The fastener 170, exclusive of bands 191 and 192, is fabricated from the same material described above relative to FIGS. 15–18.

The bandages 164 and 200 referred to above may constitute a poultice of medication wrapped in plastic, or they can constitute any other type of dressing. Also, as noted above, the quilted pad 210 is considered a bandage.

While the fastener embodiments of FIGS. 15–22 are the only ones which are specifically described for use with a bandage for a horse's leg, it will be appreciated that the fastener embodiments of FIGS. 1–14 are also manifestly suitable for this purpose.

While preferred embodiments of the present invention have been disclosed, it will be appreciated that it is not limited thereto but may be otherwise embodied within the scope of the following claims.

What is claimed is:

1. A fastener for securing a bandage applied to a leg of a horse comprising an upper band structure, a lower band structure having portions spaced from said upper band structure, first and second opposite ends on said upper band structure, third and fourth opposite ends on said lower band structure, inner and outer sides on said upper and lower band structures, bandage-facing surfaces on said inner sides of said upper and lower band structures, a first band joined to said first and third ends, a second band joined to said second and fourth ends, a first attachment member on said first band, and a second attachment member on said second band for attachment to said first attachment member.

2. A fastener as set forth in claim 1 wherein said upper and lower band structures include bands which are substantially parallel to each other.

3. A fastener as set forth in claim 1 wherein said upper and lower band structures each comprise a plurality of bands.

4. A fastener as set forth in claim 3 wherein said upper and lower band structures include upper and lower bands which are substantially parallel to each other.

5. A fastener as set forth in claim 1 including a multiple band structure extending between said upper and lower band structures.

6. A fastener as set forth in claim 5 wherein said multiple band structure comprises a plurality of substantially horizontal bands connected by a plurality of substantially vertical bands at their central portions.

7. A fastener as set forth in claim 6 including a central opening between said substantially vertical bands.

8. A fastener for securing a bandage applied to a leg of a horse comprising an upper band structure, a lower band structure spaced from said upper band structure, first and second opposite ends on said upper band structure, third and fourth opposite ends on said lower band structure, inner and outer sides on said upper and lower band structures, bandage-facing surfaces on said inner sides of said upper and lower band structures, a first band joined to said first and third ends, a second band joined to said second and fourth ends, attachment members on said first and second bands, said upper and lower band structures each comprising a plurality of bands, said plurality of bands of said upper band structure including an upper band having fifth and sixth opposite ends, third and fourth bands extending outwardly from said fifth and sixth opposite ends of said upper band, said lower band structure including a lower band having seventh and eighth ends and fifth and sixth bands extending outwardly from said seventh and eighth ends of said lower band, said third band having an outer end which is attached to an outer end of said fifth band at said first end which is a vertex, and said fourth band having an outer end which is attached to the outer end of said sixth band at said second end which is a vertex.

9. A fastener as set forth in claim 8 wherein said upper and lower bands are substantially parallel to each other.

10. A fastener for securing a bandage applied to a leg of a horse comprising an upper band structure, a lower band structure spaced from said upper band structure, first and second opposite ends on said upper band structure, third and fourth opposite ends on said lower band structure, inner and outer sides on said upper and lower band structures, bandage-facing surfaces on said inner sides of said upper and lower band structures, a first band joined to said first and third ends, a second band joined to said second and fourth ends, attachment members on said first and second bands, a multiple band structure between said upper and lower band structures, and a central opening in said multiple band structure.

11. A fastener for securing a bandage applied to a leg of a horse comprising an upper band structure, a lower band structure spaced from said upper band structure, first and second opposite ends on said upper band structure, third and fourth opposite ends on said lower band structure, a first band joined to said first and third ends, a second band joined to said second and fourth ends, and attachment members on said first and second bands, said lower band structure including a cupped portion.

12. A fastener as set forth in claim 11 wherein said cupped portion is formed by stitching two adjacent portions of said lower band structure at an angle.

13. In combination, a bandage applied to a leg of a horse and a fastener for securing said bandage in position, said fastener comprising an upper band structure, a lower band structure spaced from said upper band structure, first and second opposite ends on said upper band structure, third and fourth opposite ends on said lower band structure, a first band joined to said first and third ends, a second band joined to said second and fourth ends, and attachment members on said first and second bands, said band structures encircling said bandage, and said attachment members being secured to each other.

14. The combination as set forth in claim 13 wherein said upper and lower band structures include bands which are substantially parallel to each other.

15. The combination as set forth in claim 13 wherein said upper and lower band structures each comprise a plurality of bands.

16. The combination as set forth in claim 15 wherein said upper and lower band structures include upper and lower bands which are substantially parallel to each other.

17. The combination as set forth in claim 15 wherein said plurality of bands of said upper band structure includes an upper band having fifth and sixth opposite ends, third and fourth bands extending outwardly from said fifth and sixth opposite ends of said upper band, and wherein said lower band structure includes a lower band having seventh and eighth ends and fifth and sixth bands extending outwardly from said seventh and eighth ends of said lower band, said third band having an outer end which is attached to an outer end of said fifth band at said first end which is a vertex, and said fourth band having an outer end which is attached to the outer end of said sixth band at said second end which is a vertex.

18. The combination as set forth in claim 17 wherein said upper and lower bands are substantially parallel to each other.

19. The combination as set forth in claim 13 including a multiple band structure extending between said upper and lower band structures.

20. The combination as set forth in claim 19 wherein said multiple band structure comprises a plurality of substantially horizontal bands connected by a plurality of substantially vertical bands at their central portions.

21. The combination as set forth in claim 20 including a central opening between said substantially vertical bands.

22. The combination as set forth in claim 13 including a multiple band structure between said upper and lower band structures, and a central opening in said multiple band structure.

* * * * *